US009382662B2

(12) United States Patent
Raubic et al.

(10) Patent No.: US 9,382,662 B2
(45) Date of Patent: Jul. 5, 2016

(54) METHOD FOR IMPROVING EFFICIENCY OF UHLE BOXES IN THE PROCESS OF PAPER PRODUCTION BY APPLYING A HOMOGENEOUS MIXTURE OF SUPERHEATED HUMID AIR

(71) Applicants: Lucjan Edmund Raubic, Ottawa (CA); Teresa Janina Raubic, Ottawa (CA)

(72) Inventors: Lucjan Edmund Raubic, Ottawa (CA); Teresa Janina Raubic, Ottawa (CA)

( * ) Notice: Subject to any disclaimer, the term of this patent is extended or adjusted under 35 U.S.C. 154(b) by 0 days.

(21) Appl. No.: 14/924,693

(22) Filed: Dec. 10, 2015

(65) Prior Publication Data

US 2016/0130760 A1 May 12, 2016

Related U.S. Application Data

(63) Continuation of application No. 14/172,891, filed on Feb. 4, 2014.

(51) Int. Cl.
*D21F 7/12* (2006.01)

(52) U.S. Cl.
CPC ..... *D21F 7/12* (2013.01)

(58) Field of Classification Search
CPC ..... D21F 3/0272; D21F 1/48; D21F 7/08; D21F 7/12; F26B 13/16; F26B 13/24; Y10S 162/90; B08B 1/02; B08B 3/00; B08B 3/02; B08B 5/026; B08B 5/04
See application file for complete search history.

(56) References Cited

U.S. PATENT DOCUMENTS

| | | | | | |
|---|---|---|---|---|---|
| 3,097,994 | A * | 7/1963 | Dickens | D21F 1/48 | 162/297 |
| 3,110,575 | A * | 11/1963 | Justus | D21F 5/02 | 34/111 |
| 3,214,327 | A * | 10/1965 | Wicker | D04H 13/003 | 139/383 A |
| 3,278,368 | A * | 10/1966 | Wicker | D21F 3/029 | 162/199 |
| 3,313,679 | A * | 4/1967 | Hintermaier | D21F 7/12 | 162/199 |
| 5,314,585 | A * | 5/1994 | Ward | D21F 7/12 | 162/274 |
| 6,187,137 | B1 * | 2/2001 | Druecke | D21F 11/006 | 162/109 |
| 2002/0079076 | A1 * | 6/2002 | Bricco | D21F 1/20 | 162/203 |
| 2008/0176690 | A1 * | 7/2008 | Lefkowitz | D21F 7/086 | 474/153 |
| 2015/0218755 | A1 * | 8/2015 | Raubic | D21F 7/12 | 162/199 |
| 2016/0130760 | A1 * | 5/2016 | Raubic | D21F 7/12 | 162/199 |

FOREIGN PATENT DOCUMENTS

| | | | | |
|---|---|---|---|---|
| FI | WO 2008155461 A1 * | 12/2008 | ..... | D21F 1/32 |

* cited by examiner

*Primary Examiner* — Jose Fortuna

(57) ABSTRACT

The invention comprises a method for improving efficiency of uhle boxes in the process of paper manufacturing. The essence of the invention is the use of a homogeneous mixture of superheated humid air in the press section of a paper machine. A very intense mixing of air and steam takes place in venturi injector which creates a mixture, with appropriate composition and temperature, directed to a blowing nozzle. The mixture is then used in the forced flow through felt to a suction slot installed under the felt. The time ratio of the flow of homogeneous mixture of superheated humid air versus longitudinal movement of felt equals the actual working surface area of the suction slot. Extended working area directly influences the quality of felts conditioning and paper dewatering in the press section.

2 Claims, 4 Drawing Sheets

METHOD FOR IMPROVING EFFICIENCY OF UHLE BOXES IN THE PROCESS OF PAPER PRODUCTION BY APPLYING A HOMOGENEOUS MIXTURE OF SUPERHEATED HUMID AIR

CROSS REFERENCE TO RELATED APPLICATION

This application is a continuation of U.S. patent application Ser. No. 14/172,891, filed on Feb. 4, 2014, now abandoned.

BACKGROUND OF THE INVENTION

Currently, so called uhle boxes are used in the paper making process to condition press felts. These boxes are in fact vacuum pipes with slots of different size and shape directed towards the inside. The air flows through felt, which is moving over slots, and is then sucked off to a vacuum pump. During the process water and other contaminants from felt are sucked away together with air. This is a crucial stage for appropriate paper dewatering in the press section. Current paper machines are running at a speed much higher than the speed of air flowing through felt. The cross-directional movement of a fast moving felt versus airflow leads to a deflection of the air stream in the direction of running felt and therefore causes considerable reduction in the working surface of uhle box.

In case of very fast paper machines this leads to a total cancellation of the open airflow surface and consequently hinders any felt conditioning.

The presented method improves the currently employed technologies in order to enhance paper production process.

BRIEF SUMMARY OF THE INVENTION

The objective of the invention is to provide an improved felts conditioning method for paper machines with the use of a specifically prepared homogeneous mixture of superheated humid air and steam which enhances functioning of existing systems of uhle boxes used for felts cleaning and dewatering.

DETAILED DESCRIPTION OF THE INVENTION

The invention comprises a method for improving efficiency of uhle boxes in the process of paper manufacturing.

In the paper manufacturing process there's a need to dewater and dry the end product. The degree to which paper is dewatered is of great importance because it directly impacts how much energy is saved further in the production process, particularly in the drying process.

The invention comprises the method for improving efficiency of uhle boxes.

Figure 1:
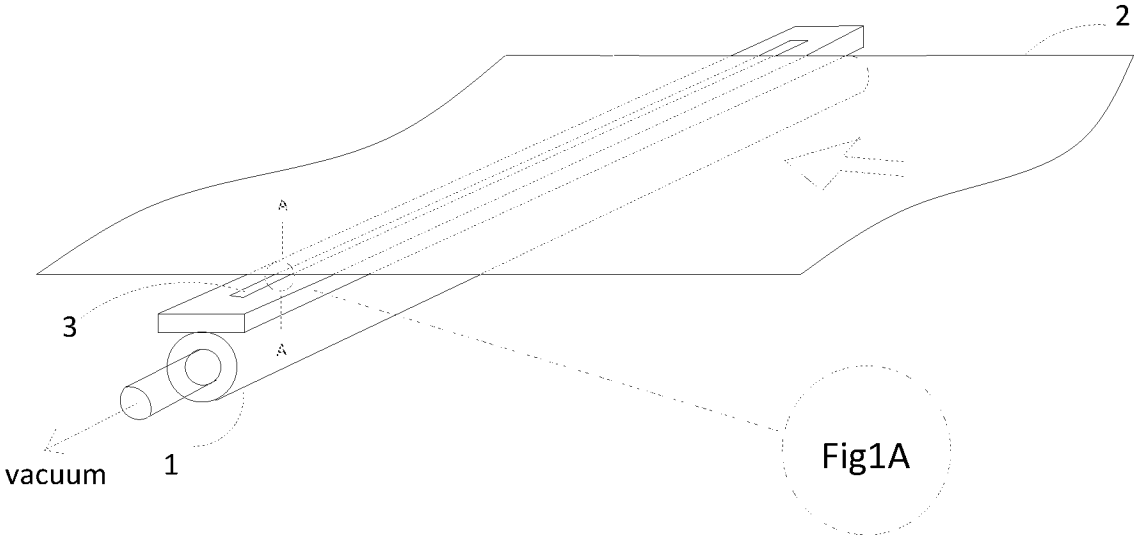
Fig1 Prior Art
FIG. 1 is a schematic view of uhle box with press felt moving above it; in fact, it is a commonly used device in the paper manufacturing industry.
Figure 1A:
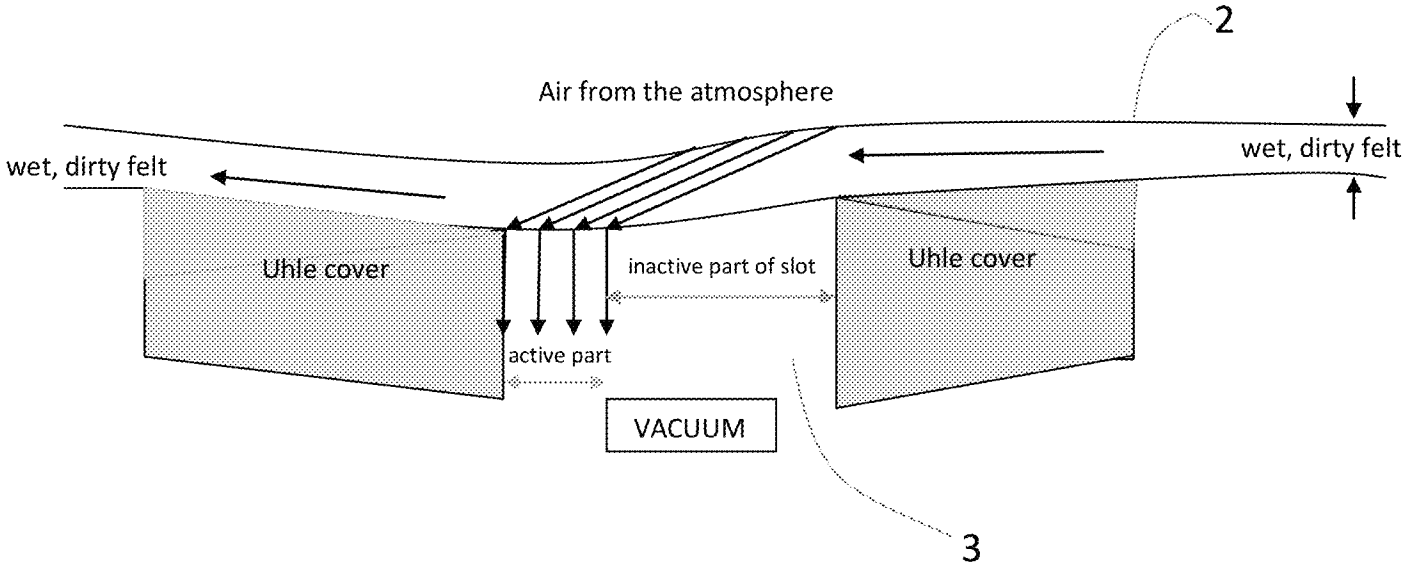
FIG. 1A is a side elevation view of the situation taking place inside the vacuum slot of uhle box for atmospheric air penetrating felt.

Contemporary paper machines are running at a speed much higher than the speed of atmospheric air flowing through felt [FIG. 1]. The cross-directional movement of a fast moving felt (2) versus airflow leads to a deflection of the airstream in the direction of running felt and therefore causes considerable reduction in the working surface (3) of uhle box (1) [FIG. 1A].

Figure 2:
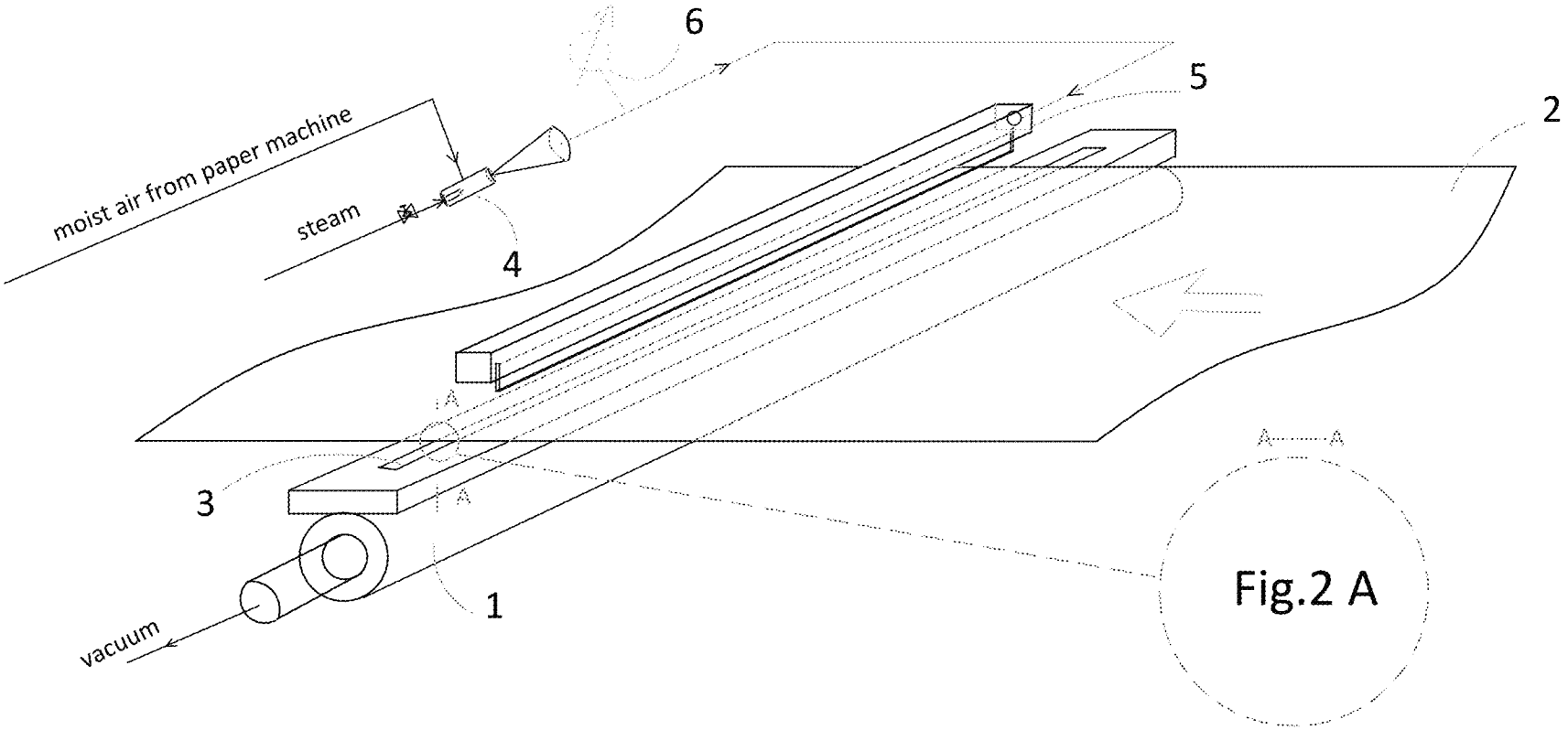
FIG. 2 is a schematic view of uhle box with the presented invention system installed.
Figure 2A:
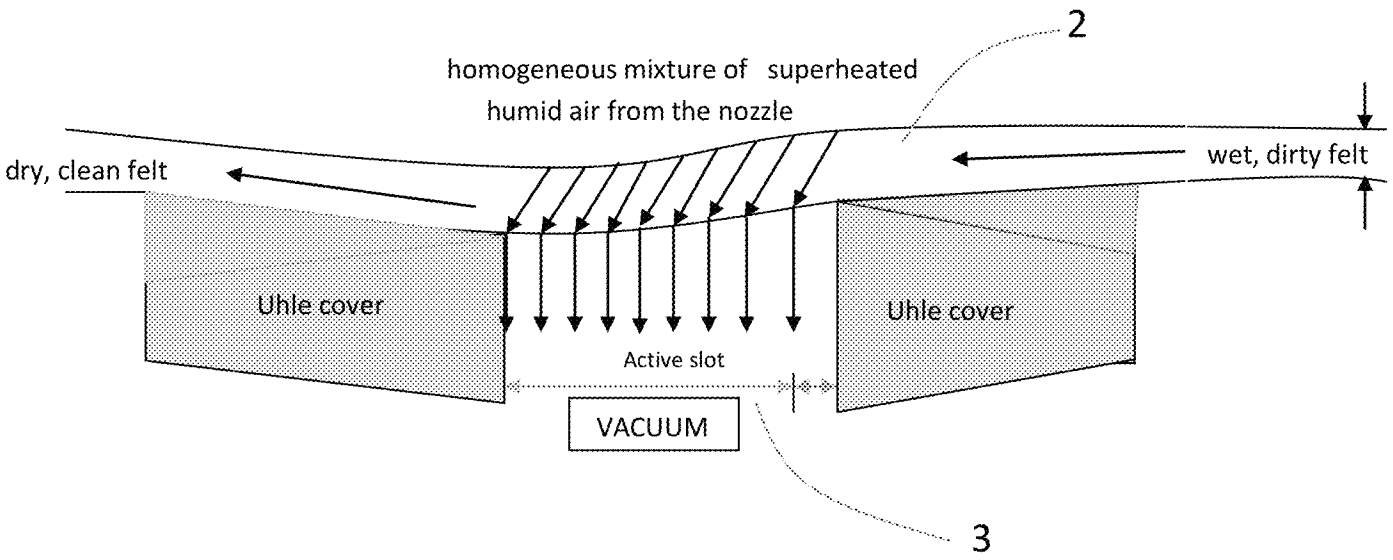
FIG. 2A is a side elevation view in uhle box vacuum slot for homogeneous mixture of superheated humid air penetrating felt.

The essence of felt conditioning with the presented system [FIG. 2] is the increase in the working surface (3) of existing uhle boxes (1) thanks to a higher speed of homogeneous superheated humid airflow through felt (3). The method is based on the Darcy-Weisbach equation: $Wa=\sqrt{(1/K)}\times\sqrt{(2\Delta P/d)}$ Wa—air speed inside the felt, d—density of air, ΔP—vacuum level, K—Darcy friction factor (depending on dwell time, contamination, felt compaction, water content). The homogeneous superheated humid air is around 2, 5 times less dense than atmospheric air. According to the suggested equation the speed of mixture flow through felt is inversely proportional to the square root of the density. Reducing the density will therefore increase the flow velocity of the mixture in relation to clean air $\sqrt{(2.5)}=1.58$ times. This in turn will shorten the time of the mixture flow and will reduce the deviation of the stream through moving felt [FIG. 2A]. In consequence, the working surface (3) of uhle box (1) is larger and because of that felt (2) conditioning improves.

Homogeneous superheated humid air from blowing nozzle is sucked into uhle box (1) [FIG. 2] through felt (2) which is being dewatered in the process. A moist air can be taken from anywhere in the paper machine for example from the outlet of a dryer, from exhaust of a dryer burner, from outlet of vacuum pumps or from vacuum separators and, if temperature of moist air is too low, it is then superheated by fresh steam in venturi injector (4)[FIG. 2]. Venturi injector is powered by steam with a pressure of 35 to 200 PSI and it sucks moist air. With the help of thermometer and condensation hygrometer (6) [FIG. 2] a temperature of the mixture and the saturation temperature (dew point) for water vapor in air is measured after venturi injector. By regulating the steam quantity it is possible to determine the appropriate temperature of the mixture after venturi injector such that it is at least 10 F above the temperature of the dew point. Then this homogenous mixture (it means a mixture of gases without water droplets) of superheated humid air is directed toward to a blowing nozzle (5) [FIG. 2] and then is sucked in by felt (2) into linear or herringbone slots (3) of uhle box (1).

The dwell time of felt in the open area of uhle box is crucial because it directly impacts water and contaminants removal from felt. A portion of moisture evaporates and is sucked away. The remainder of water in the liquid form is substantially easier to suck off in higher temperature due to decrease in its viscosity and density. As a consequence, simultaneous sucking and preheating of felt by means of air-steam flow impacts the intensification of paper dewatering in the press section of the paper machine. As a result, paper web subjected to thermal drying is characterized by higher dryness.

The invention claim is:

1. A method of improving efficiency of uhle boxes in a process of paper production comprising, blowing a superheated humid air through a felt to an uhle box, wherein:

a) said humid air is superheated by a minimum of 10 F in relation to the temperature of the dew point b) the temperature of said humid air is between 150-400 F and absolute pressure is between 15.5-100 PSI.

2. The process of claim 1 wherein said humid air is taken from a dryer or a vacuum section of a paper machine and then is superheated by fresh steam in a venturi injector.

* * * * *